US007478810B2

(12) United States Patent
Sting et al.

(10) Patent No.: US 7,478,810 B2
(45) Date of Patent: Jan. 20, 2009

(54) ROTARY FEEDER WITH CAM ACTUATED CLAW MEMBERS

(75) Inventors: Martin Sting, Bad Vibel (DE); Christian Botschek, Rodermark (DE); Rainer Oberheim, Bensheim (DE)

(73) Assignee: Pitney Bowes Deutschland GmbH, Heppenheim (DE)

( * ) Notice: Subject to any disclaimer, the term of this patent is extended or adjusted under 35 U.S.C. 154(b) by 214 days.

(21) Appl. No.: 11/156,397

(22) Filed: Jun. 20, 2005

(65) Prior Publication Data

US 2005/0285333 A1 Dec. 29, 2005

(30) Foreign Application Priority Data

Jun. 23, 2004 (DE) ..... 10 2004 030 254

(51) Int. Cl.
*B65H 5/12* (2006.01)

(52) U.S. Cl. ..... 271/277; 271/275; 271/11

(58) Field of Classification Search ..... 271/275, 271/11, 277

See application file for complete search history.

(56) References Cited

U.S. PATENT DOCUMENTS 3,643,598 A * 2/1972 Papa et al. ..... 101/420
4,132,403 A * 1/1979 Weisbach et al. ..... 271/277
4,358,100 A * 11/1982 Muller ..... 271/11

(Continued)

FOREIGN PATENT DOCUMENTS

DE 4343146 A1 12/1993
GB 2275917 A * 9/1994

*Primary Examiner*—Kaitlin S Joerger
*Assistant Examiner*—Gerald W McClain
(74) *Attorney, Agent, or Firm*—Christopher H. Kirkman; Steven J. Shapiro; Angelo N. Chaclas

(57) ABSTRACT

In a rotary feeder for conveying enclosures, in particular into conveying compartments of an enclosure-collating path, during operation, shocks within the gear mechanism of the drive unit of the feeder drum on account of gear mechanism play are avoided and the level of noise during operation is reduced in that a cam-actuated pair of claws (10, 11) is provided in each case at two diametrically opposite locations of the feeder drum (2) of the rotary feeder, and the cam (16) for actuating the pairs of claws is configured in sections (O) with an increasing in the radial spacing of its profile in accordance with a claw-opening movement counter to the prestressing force of prestressing means (19, 20) and, in sections (C) with a decrease in the radial spacing of its profile in accordance with a claw-closing movement under the prestressing force of the prestressing means, such that a braking moment on account of the claw opening counter to the prestressing force of the prestressing means, this braking moment being transmitted to a rotating follower roller (15) and a link (14), bearing the latter, for claw actuation, and to the feeder drum (2) via the claw pivoting shaft (9), is compensated for by an accelerating moment on account of the claw closure under the prestressing force of the prestressing means, this accelerating moment being transmitted to a rotating follower roller (15) and a link (14), bearing the latter, for claw actuation, and to the feeder drum (2).

19 Claims, 1 Drawing Sheet

U.S. PATENT DOCUMENTS 4,390,176 A * 6/1983 Kato ..... 271/270
4,489,931 A * 12/1984 Costa et al. ..... 271/277
4,807,867 A * 2/1989 Lippold et al. ..... 271/277
4,875,669 A * 10/1989 McCain et al. ..... 270/52.27
5,141,221 A * 8/1992 Mack et al. ..... 271/270
5,447,302 A * 9/1995 Curley ..... 271/277
5,794,929 A * 8/1998 Curley et al. ..... 271/270
5,893,824 A * 4/1999 Schlough ..... 493/409
6,375,182 B1 * 4/2002 Sting et al. ..... 271/10.03
6,547,297 B2 * 4/2003 Cote et al. ..... 294/104

* cited by examiner

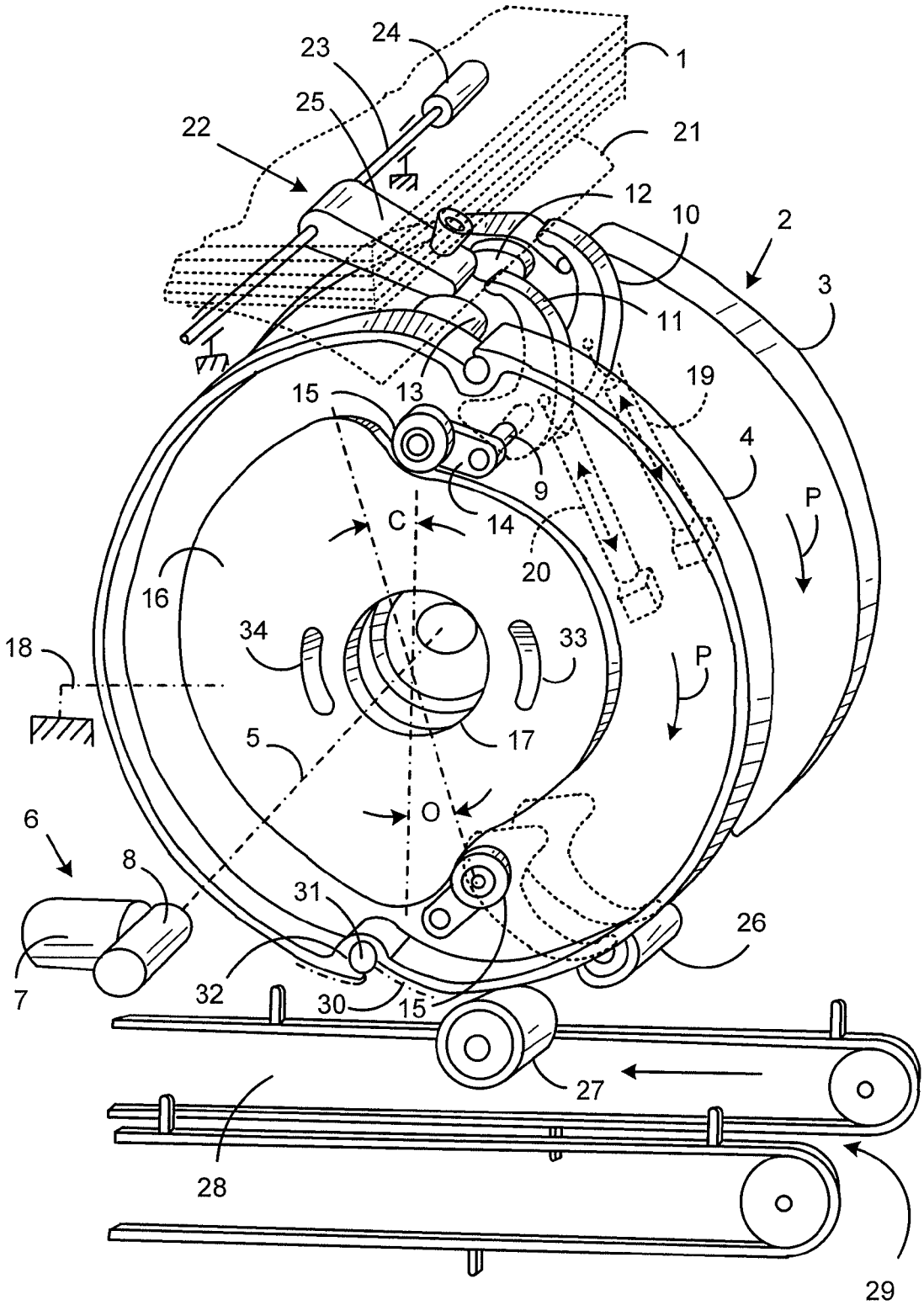
24
23
1
25
22
21
12
10
2
3
11
19
15
13
4
9
P
C
14
20
16
34
33
18
P
17
5
O
6
8
31
26
7
32
30
15
27
28
29

ROTARY FEEDER WITH CAM ACTUATED CLAW MEMBERS

BACKGROUND OF THE INVENTION

The invention relates generally to mail processing machines and in detail to a rotary feeder, in particular for inserting enclosures into conveying compartments of an enclosure-collating path.

Such rotary feeders which have a feeder drum which can be made to rotate by a drive motor, via a gear mechanism forming a drive unit with the drive motor and fastened on a drive shaft coupled to the gear mechanism have been on the market for some time. On the feeder drum, pairs of claws are mounted on pivoting shafts, can be pivoted in radial planes in relation to the feeder-drum axis of rotation and can be moved into an open position counter to the prestressing force of prestressing means or spring means, via cam follower rollers and a housing-mounted cam, as the drum rotates, counter to the force of the spring means and into a closed position by the spring force of the prestressing means or spring means as the drum rotates further, such that the claws of a pair of claws grip an enclosure edge of a respectively lowermost enclosure of an enclosure stack and, as the drum continues to rotate, draw this lowermost enclosure out of the enclosure stack and guide the enclosure around the drum circumference and, for example, transport it in the direction of a conveying compartment of an enclosure-collating path.

If the enclosures to be handled by the rotary feeder have a length in the circumferential direction of the feeder drum of less than half the feeder-drum circumference, during a complete feeder-drum rotation, two enclosures can be deposited in successive conveying compartments of the enclosure-collating path as a result of the fact that the feeder drum is provided at two diametrically opposite points with cam-actuated pairs of claws in each case, of which one pair of claws grips the enclosure edge of the lowermost enclosure of the enclosure stack while the other pair of claws releases the leading enclosure edge of an enclosure gripped previously and conveyed around the feeder-drum circumference by means of moving the claws of the relevant pair of claws in the opening direction, so that this enclosure is then deposited, for example in the conveying compartment of the enclosure-collating path.

In order to ensure secure gripping of the leading enclosure edge by clamping the same between the tips or front ends of the claws of the pair of claws, on the one hand, and supporting parts fastened to side surfaces of the feeder drum on the other hand, the claws are spring-loaded via very powerful prestressing springs about their pivot axes mounted on the feeder drum, which has the effect that, when the follower roller, which is coupled to the pivoting shaft of a pair of claws via a link and which is assigned to a pair of claws opening counter to the prestressing force of the prestressing means, rides up from small radii to a large radius at a transition of the cam, mounted so as to be stationary, a considerable braking moment acts on the feeder drum. On the other hand, moving the follower roller assigned to a closing pair of claws down at a transition from large radii to small radii of the cam, mounted so as to be stationary, when this follower roller is pressed on via the link by means of the powerful prestressing means of this pair of claws, has the effect that, in the closing phase of a pair of claws, a powerful accelerating moment is exerted on the feeder drum.

A chronologically quick succession of an accelerating moment and a decelerating moment during the drum rotation has the effect of shocks in the gear mechanism of the drive unit of the feeder drum within the gear mechanism play, which intensify the wear of the gear mechanism, stress the mounting of the drive unit and cause an unpleasant noise.

Furthermore, the short-term succession of the aforementioned accelerating moment and of the braking moment can lead to oscillation of the drive speed of the feeder drum, in such a way that, for example after gripping the leading enclosure edge of the lowermost enclosure of the enclosure stack and drawing this enclosure out of the enclosure stack, the circumferential speed of the feeder drum decreases suddenly or even a short-term reversal of the direction of rotation occurs, which results in the enclosure currently to be drawn out of the enclosure stack curving up somewhat and, after the regular rotation of the feeder drum has been resumed, being tensioned and then placed on the circumference of the feeder drum again with a cracking noise.

SUMMARY OF THE INVENTION

The object of the invention is to configure a rotary feeder of the general type described at the beginning in such a way that, during operation, shocks within the gear mechanism of the drive unit of the feeder drum on account of gear mechanism play are avoided and the level of noise during operation is reduced.

According to the invention, this object is achieved in that the cam, fixed to the housing, for actuating the pairs of claws mounted at the two diametrically opposite locations of the feeder drum is configured in sections with an increase in the radial spacing of its profile in accordance with a claw-opening movement counter to the prestressing force of the prestressing means and, in sections with a decrease in the radial spacing of its profile in accordance with a claw-closing movement under the prestressing force of the prestressing means, such that a braking moment on account of the claw opening counter to the prestressing force, this braking moment being transmitted to a rotating follower roller and a link, bearing the latter, for claw actuation, and to the feeder drum, is compensated for by an accelerating moment on account of the claw closure under the prestressing force, this accelerating moment being transmitted to a rotating follower roller and a link, bearing the latter, for claw actuation, and to the feeder drum.

Although, according to an advantageous embodiment, the claws of a pair of claws have a relatively short radial length in relation to their pivot axis and are actuated over a pivoting range of 90° by comparatively short links, bearing the associated follower roller, and accordingly comparatively powerful prestressing means in the shape of very powerful compression spring elements on short lever arms act on the claws of the pairs of claws in relation to the pivot axis, the construction specified here makes it possible to damp the considerable drive-moment fluctuations during the claw opening and in the claw closing position to the greatest possible extent by means of mutual compensation, which makes it possible to provide a comparatively simple and cheap drive for the feeder drum.

In order to even out the run of the feeder drum, it is not necessary to provide this with a balance mass. Instead, the feeder drum can be constructed from drum plates which are formed from plastic moldings and have comparatively low masses.

In the following text, an exemplary embodiment will be explained in more detail with reference to the appended drawing, in which the substantial parts of a rotary feeder of the type specified here are shown in a schematic and perspective representation.

BRIEF DESCRIPTION OF THE DRAWING

FIG. 1 depicts an isometric view of a rotary feeder.

WRITTEN DESCRIPTION

Underneath an enclosure stack 1 held in an enclosure magazine and indicated by dash-dotted lines there is the feeder drum 2 of the rotary feeder, which is built up from two drum plates 3 and 4, which are fastened with a specific axial spacing on a drive shaft 5 merely indicated schematically in the drawing. The drive shaft 5 is mounted on one side or on each side of the feeder drum 2 and is coupled to a drive unit 6 which comprises a drive motor 7 and a gear mechanism 8.

At a specific radial distance from the axis of the drive shaft 5, between the drum plates 3 and 4, pivoting shafts, of which one is shown in the drawing and designated 9, are mounted at diametrically opposite points. Fastened to the pivoting shafts are claws 10 and 11 of one of two pairs of claws in each case, which can be pivoted into the interspace between the drum plates 3 and 4 in each case arranged laterally beside said claws and in radial planes which are oriented parallel to the radial central planes of the drum plates 3 and 4. The claws 10 and 11 of a pair of claws in each case interact with the claws of respectively opposite supporting parts 12 and 13 fastened on the inner side surfaces of the drum plates 3 and 4.

On the side of the feeder drum 2 facing the drive unit 6, the pivoting shafts 9 are led through the drum plate 4 and bear a link 14, at the free end of which in each case a follower roller 15 is mounted. The follower rollers 15 are used to follow a cam 16 which is provided with a central aperture 17, through which the drive shaft 5 of the feeder drum reaches. The cam 16, as indicated schematically at 18, is mounted firmly on the housing, in such a way that, when the feeder drum 2 is driven by the drive unit 6, the pivoting shafts 9 provided with the links 14 and the follower rollers 15 are guided around the cam 16 and, on account of the profiling of the cam 16, as the feeder drum 2 rotates in the direction of the arrows P, closure of the claws 10 and 11 against the supporting parts 12 and 13 under the prestressing force of compression spring elements 19 and 20 is carried out when the claws 10 and 11 are located underneath the enclosure stack 1, while opening of the claws 10 and 11 counter to the prestressing force of the compression spring elements 19 and 20 is carried out when the feeder drum 2 has moved onward by approximately half a revolution.

In order that the claws 10 and 11, in the position of a pair of claws reproduced in the upper part of FIG. 1, grip the enclosure leading edge of a respective lowermost enclosure of the enclosure stack 1 and, as the claw closing movement is continued, can press against the supporting parts 12 and 13, as indicated at 21 by dash-dotted lines in FIG. 1, the lowermost enclosure is gripped by a vacuum sucker device 22 and bent downward against the circumference of the feeder drum 2. The vacuum sucker device 22 has a vacuum sucker carrier 25 which can be moved in the space between the drum plates 3 and 4 and can be pivoted under control on a shaft 23 by means of a drive 24.

According to a modified design, not shown in the drawing, the leading edge of a respective lowermost enclosure of an enclosure stack of comparatively thick enclosures can also be advanced by a pusher device into the region of the clamping gap between the tips of the claws 10 and 11 of a pair of claws and the associated supporting parts 12 and 13.

Then, when the feeder drum 2 has executed about half a drum revolution, the enclosure clamped in between the claws of a pair of claws is clamped in and conveyed onward between roller nips, which are formed between the respective outer circumference of the drum plates 3 and 4, on the one hand, and supporting rollers 26 and 27 prestressed in a sprung manner against these circumferential surfaces, on the other hand. Once an enclosure has been gripped by these roller nips, the pair of claws clamping the relevant enclosure in can then be moved into the open position, for which purpose the follower roller 15 associated with this pair of claws, which is illustrated in the lower region of the cam 16 in the drawing FIGURE, rides up on a flank of the cam 16 to circumferential parts of the can having a larger radius, pivots the link 14 bearing it and the associated pivoting shaft 9 counter to the force of the associated compression spring elements 19 and 20 and, as a result, pivots the associated pair of claws into the open position. The enclosure released by the claws of a pair of claws is then conveyed out of the roller nips between the drum plates 3 and 4 and the supporting rollers 26 and 27 by the rotation of the feeder drum 2 and is inserted into a conveying compartment 28 of an enclosure-collating path 29. The enclosure-collating path 29 is, for example, formed in a known manner by endless conveyor belts or conveyer chains located beside one another and fitted with conveyor fingers, conveyor fingers located beside one another in the conveying direction of the enclosure-collating path 29 in each case defining a conveying compartment.

In the present design of a rotary feeder, it is of great importance that, when, during the feeder-drum rotation, the follower roller 15 assigned to the pair of claws in a closing phase runs over a transition region C of the housing-mounted cam 16, in which the cam profile changes from larger radii to smaller radii, that follower roller 15 which is assigned to a pair of claws in the opening phase runs over a transition region O of the cam 16 in which the cam profile changes from regions of smaller radii to a region of larger radii. This design achieves the situation where the accelerating moments which are produced by the interaction of the compression spring elements 19 and 20, the claws 10 and 11, the pivoting shaft 9, the link 14 and the follower roller 15, on the one hand, and the region C of decreasing radius of the housing-mounted cam 16, on the other hand, and acting on the feeder drum, are compensated by the deceleration moments which are caused by the interaction of the lower compression spring elements 19 and 20, which are not shown in the drawing figure, the associated claws 10 and 11, the associated pivoting shaft 9, the link 14 and the follower roller 15, on the one hand, and of the region O of the cam 16 rising from smaller radii to greater radii, on the other hand.

The compensation for the braking moments and accelerating moments produced by the claw opening and claw closing counter to prestress or under prestress is of particular importance when, because of relatively small radial dimensions of the claws relative to their pivoting shaft 9 and because of relatively small radial dimensions of the links 14 bearing the follower rollers 15, very powerful compression spring elements 19 and 20 are used as prestressing means, so that the resultant braking moments and accelerating moments during drum rotation also become high. A small radial dimension of the claws 9 and 10 and a small radial length of the links 14 from their fastening point to the pivoting shaft 9 for the mounting of the follower roller 15 will be selected in order, within a small angle of rotation of the feeder drum 2, to achieve pivoting of the claws 9 and 10 through approximately 90° from the closed position into the completely open position and from the open position into the completely closed position, which achieves secure gripping of a leading enclosure edge as the claws move into the closed position and secure release of the enclosure as the claws move into the open position.

Reference should be made here to an expedient refinement of the feeder drum 2, which is indicated only schematically in the drawing FIGURE.

In order to improve the friction between the outer circumference of the drum plates 3 and 4, on the one hand, and the material of an enclosure 21 to be handled from the enclosure stack 1, on the other hand, the circumferential surface of the drum plates 3 and 4 can be closed with a strip of elastic material, which is indicated at 30 in the drawing FIGURE and, under elastic tension, is anchored around the circumference of the drum plates 3 and 4 by means of locking pins 31 in niches 32, in which in each case the locking pin 31 is secured by being clamped with the interposition of the elastic strip 30. The increase in the friction between the outer circumference of the drum plates 3 and 4 by the elastic strip 30 also improves the conveying action in the region of the supporting rollers 26 and 27 prestressed against the feeder-drum circumference.

Finally, the drawing FIGURE also reveals curved apertures 33 and 34 in the housing-mounted cam 16 which are concentric with respect to the drive shaft 5. These apertures are used for fastening the cam 16 on parts of the framework of the rotary feeder or on a side wall of the gear mechanism 8 of the drive unit 6, it being possible for the rotary position of the cam 16 to be set in order to adjust the position of the regions C and O of the cam profile.

As already indicated previously, the feeder 2 does not need to be provided with an enlarged inertial mass in order to even out its rotary movement. Instead, the drum plates 3 and 4 can be formed as plastic injection moldings.

The invention claimed is:

1. A rotary feeder for conveying enclosures, the feeder comprising:

a feeder drum;

a drive unit that drives rotation of the feeder drum;

a cam-actuated pair of claws mounted at diametrically opposite locations on the feeder drum, wherein the claws are pivoted into an open position counter to a prestressing force of a prestressing means via cam follower rollers and a cam as the drum rotates, and wherein the claws are pivoted into a closed position under the prestressing force of prestressing means as the drum rotates further, such that a claw grips an enclosure border of a respectively lowermost enclosure of an enclosure stack and, as the drum continues to rotate, draws this lowermost enclosure out of the enclosure stack and guides the enclosure around a circumference of the feeder drum;

wherein the cam is configured in a first section with an increase in radial spacing of its profile in accordance with a claw-opening movement and in a second section with a decrease in the radial spacing of its profile in accordance with a claw-closing movement, such that a braking moment caused by the claw opening counter to the prestressing force of the prestressing means is compensated for by a substantially simultaneous and substantially equivalent accelerating moment caused by the claw closure under the prestressing force of the prestressing means.

2. The rotary feeder of claim 1, wherein a rotary position of the cam is adjustable in relation to an axis of a drive shaft of the feeder drum.

3. The rotary feeder of claim 1, wherein the feeder drum comprises two axially spaced apart drum plates, and wherein the claws are pivotably disposed between the drum plates.

4. The rotary feeder of claim 3, wherein the drum plates comprise plastic moldings.

5. The rotary feeder of claim 3, further comprising elastic strips disposed on an outer circumference of the drum plates.

6. A rotary feeder, comprising:

a rotatable feeder drum;

a stationary cam proximate to the feeder drum, the cam having a cam surface defining a first surface portion and a second surface portion diametrically opposite to the first surface portion;

a first claw assembly disposed on the feeder drum in a first location;

a second claw assembly disposed on the feeder drum in a second location diametrically opposite to the first location, each claw assembly comprising:

a rotatable shaft;

a claw element disposed on a first end of the rotatable shaft, the claw element movable between a closed position for securing an item for rotation with the feeder drum and an open position for releasing the item;

an elastic element biasing the claw element to the closed position; and a roller assembly disposed on a second end of the rotatable shaft the roller assembly comprising a roller engaging the cam surface, wherein rotation of the feeder drum engages the roller of the first claw assembly with the first surface portion, moving the claw element of the first claw assembly to the closed position, and substantially simultaneously engages the roller of the second claw assembly with the second surface portion, moving the claw element of the second claw assembly to the open position, and wherein an accelerating moment caused by movement of the claw element of the first claw assembly to the closed position is offset by a substantially equivalent decelerating moment caused by movement of the claw element of the second claw assembly to the open position.

7. The rotary feeder of claim 6, wherein the feeder drum comprises two substantially concentric, substantially parallel plates.

8. The rotary feeder of claim 7, wherein the claw element of each claw assembly is disposed substantially between the plates.

9. The rotary feeder of claim 6, wherein each claw assembly further comprises a stationary claw surface disposed on the feeder drum that interacts with the claw element in the closed position.

10. The rotary feeder of claim 6, wherein the claw element comprises a plurality of claws.

11. The rotary feeder of claim 6, further comprising an elastic material disposed on an outer surface of the feeder drum to increase friction between the outer surface of the feeder drum and the item.

12. The rotary feeder of claim 6, wherein further rotation of the feeder drum engages the roller of the first claw assembly with the second surface portion, moving the claw element of the first claw assembly to the open position, and simultaneously engages the roller of the second claw assembly with the first surface portion, moving the claw element of the second claw assembly to the closed position.

13. The rotary feeder of claim 6, wherein the roller assembly of each claw assembly further comprises a pivoting link having a first end fixedly secured to the second end of the rotatable shaft and a second end rotatably supporting the roller.

14. The rotary feeder of claim 6, wherein the elastic element comprises a compression spring.

15. The rotary feeder of claim 6, wherein the cam surface in the first surface portion transitions from a larger radius to a smaller radius.

16. The rotary feeder of claim 6, wherein the cam surface in the second surface portion transitions from a smaller radius to a larger radius.

17. The rotary feeder of claim 6, wherein the item comprises a mail piece.

18. The rotary feeder of claim 6, wherein the cam is substantially concentric with the feeder drum.

19. A rotary feeder, comprising:

a rotatable feeder drum;

a cam proximate to the feeder drum, the cam having a cam surface defining a first surface portion and a second surface portion diametrically opposite to the first surface portion;

a first claw assembly disposed on the feeder drum in a first location;

a second claw assembly disposed on the feeder drum in a second location diametrically opposite to the first location, each claw assembly comprising:

a rotatable shaft;

a plurality of claws disposed on a first end of the rotatable shaft, the claws movable between a closed position for securing an item from a stack of similar items for rotation with the feeder drum and an open position for releasing the item;

an elastic element biasing the claws to the closed position; and a roller assembly disposed on a second end of the rotatable shaft, the roller assembly comprising a roller engaging the cam surface, wherein rotation of the feeder drum engages the roller of the first claw assembly with the first surface portion, moving the claws of the first claw assembly to the closed position, and substantially simultaneously engages the roller of the second claw assembly with the second surface portion, moving the claws of the second claw assembly to the open position, and wherein an accelerating moment caused by movement of the claws of the first claw assembly to the closed position is offset by a substantially equivalent decelerating moment caused by movement of the claws of the second claw assembly to the open position.

* * * * *